United States Patent [19]

Meier

[11] Patent Number: 4,930,324

[45] Date of Patent: Jun. 5, 1990

[54] CENTER-RELEASE, LOCKABLE BUCKLE

[75] Inventor: Terrence P. Meier, Wheaton, Ill.

[73] Assignee: Illinois Tool Works, Inc., Chicago, Ill.

[21] Appl. No.: 428,788

[22] Filed: Oct. 30, 1989

[51] Int. Cl.[5] ..... E05B 73/00

[52] U.S. Cl. ..... 70/18; 70/49

[58] Field of Search ..... 70/18, 14, 30, 49, 69; 24/614, 615, 644, 167, 170, 193

[56] References Cited

U.S. PATENT DOCUMENTS

| | | | |
|---|---|---|---|
| 3,592,028 | 7/1971 | La Monica | 70/57 |
| 4,398,324 | 8/1983 | Bakker | 24/615 |
| 4,679,282 | 7/1987 | Feng | 24/615 |
| 4,685,315 | 8/1987 | Comolli | 70/18 |
| 4,800,629 | 1/1989 | Ikeda | 24/170 |

*Primary Examiner*—Robert L. Wolfe

*Attorney, Agent, or Firm*—Thomas W. Buckman; John P. O'Brien; Donald J. Breh

[57] ABSTRACT

A center-release buckle with a rotatable lock to secure a cover or belt, which lock is mounted in the buckle against a flexible flap in the buckle housing and is secured therein by mounting the housing on a base or frame.

11 Claims, 2 Drawing Sheets

CENTER-RELEASE, LOCKABLE BUCKLE

BACKGROUND OF THE INVENTION

The present invention generally relates to a buckle and more particularly to a center-release buckle, which is lockable to secure a retained apparatus such as a belt, strap or cover.

Buckles generally are used on pant belts, safety belts and container covers to secure various belt ends. Buckle assemblies for securing have classically encompassed two basic members, a clasp or latch and a clasp fastener, which members are matable to secure the above-noted belt, cover or other element. Many of these buckles utilize a release mechanism to disengage the mating latch and fastener.

Illustrative of a side-engaging and releasing buckle assembly is the structure shown in U.S. Pat. No. 4,150,464 to Tracy, which has a buckle with locking tabs matable in a receptacle. The tabs are engageable with sidewall slots to secure the buckle, and subsequent depression of these tabs in the slots permits withdrawal of the buckle and disengagement of the connected members. Similarly operable buckles are shown in U.S. Pat. Nos. 4,631,787; 4,662,040; and, 4,712,280.

Many buckle assemblies have locking means to fix the clasp and fastener against inadvertent or unwanted disengagement. Indicative of a locking buckle assembly is the structure shown in U.S. Pat. No. 1,665,303 to Hunter, which uses a keeper in the casing rotatable by a key to maintain the securing tabs in their slots. Counter rotation of the key and keeper permits disengagement of the clasp and fastener. This buckle is composed of a plurality of discrete components, which imposes an assembly expense to provide the finished buckle. Alternative latching and locking devices are disclosed in U.S. Pat. Nos. 1,139,316; 2,940,291; and, 3,008,319. However, almost all of these securing devices operate to maintain the above-noted tabs sidewardly projecting to contact hooks or slots. A lock having a central cam with a groove-tracking pintle is operable with side projecting fingers for securing coupled members, as noted in U.S. Pat. No. 4,500,120 to Ridgewell et al.

Center-release buckles are used as an alternative coupling arrangement for buckle fasteners and are exemplified by the structures shown in U.S. Pat. Nos. 4,398,324 to Bakker et al. and 4,633,549 to Lovato. In the Bakker-'324 patent a clasp tongue is insertable in a fastener receptacle and a raised tongue portion is urged to mate with an aperture in the receptacle top wall to secure the buckle assembly. The releasable buckle in the Lovato-'549 patent includes a tongue that extends essentially to the rearmost portion of the receptacle casing before coming into register with a locking edge.

It is desirable from aesthetic, economic and functional considerations to provide a center-release buckle with a locking apparatus to prevent inadvertent or unwanted release of a coupled buckle fastener and to produce the buckle with a minimal amount of assembly.

SUMMARY OF THE INVENTION

The present invention provides a center-release buckle incorporating all functional elements in a minimal number of discrete components, which assembly is economically produced and easily assembled. The structure utilizes an interlocking clasp and casing and a tumbler with a projecting arm to securely lock the clasp in the coupled mode. The single-component tumbler is easily inserted in the casing but is fixedly retained in position after mounting the casing on a frame or support for subsequent engagement with the clasp, which secures a belt strap or other element coupled to the clasp. The clasp tongue, a bias means, and a fulcrum are a unitary component.

BRIEF DESCRIPTION OF THE DRAWINGS

In the figures of the drawings, like reference numerals like components, and in the drawing.

DETAILED DESCRIPTION OF THE PREFERRED EMBODIMENT

Figure 1:
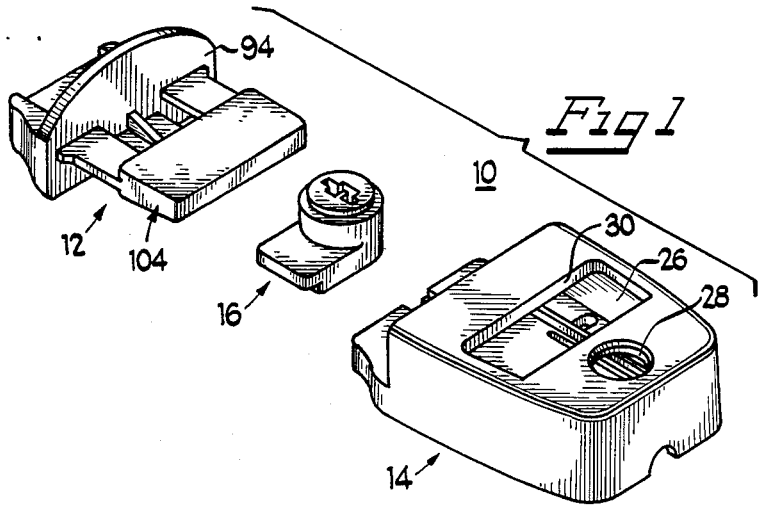
FIG. 1 is an exploded perspective view of the buckle assembly.
Figure 2:
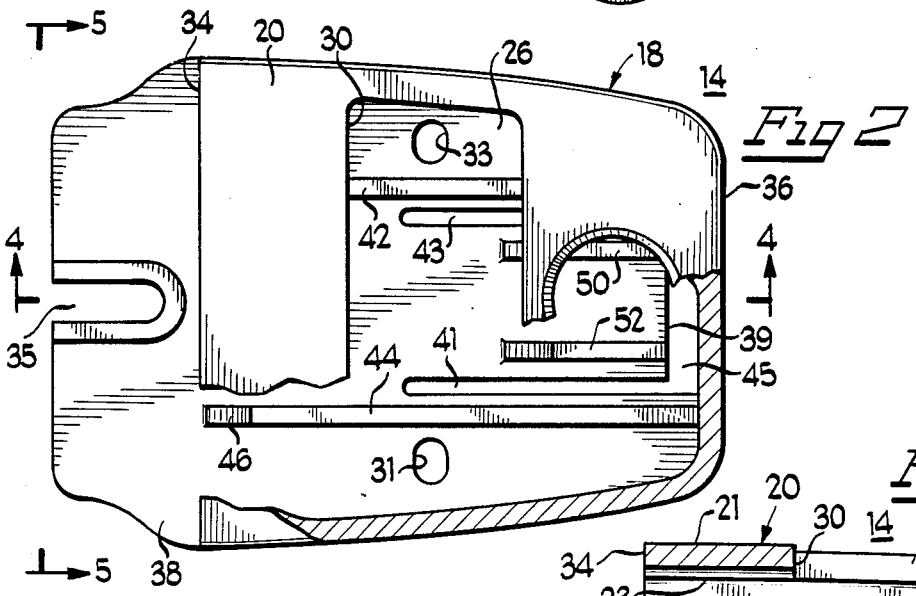
FIG. 2 is a top plan view of the housing in partial section.

Buckle fasteners are utilized for joining and coupling various belts, straps or covers, as well as other connecting functions. In FIG. 1, a center-release buckle assembly 10 is illustrated in an exploded perspective view with clasp member 12, housing or casing 14 and locking tumbler 16. In this embodiment, housing 14 with tumbler 16 is mountable on a securing member or base (not shown) which base may be fixed or movable. Clasp member 12 is generally connected to the end of a belt, strap or structure 15 (cf. FIG. 6) for subsequent coupling to housing 14, which secures the device end and housing 14. As an example, housing 14 may be mounted on the frame or base of a hot tub or spa (not shown) and clasp member 12 may be connected to a tub cover (not shown). Interlocking of clasp 12 and housing 14 secures the cover over the tub to prevent unwanted material from entering and contaminating the tub. Rotation of locking tumbler 16 locks interengaged clasp 12 and housing 14 to insure that the cover will not be removed.

Figure 4:
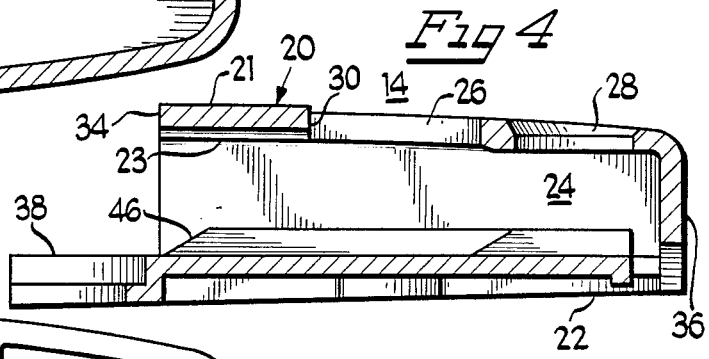
FIG. 4 is an elevational view in section of the housing along the line 4—4 of FIG. 2.
Figure 3:
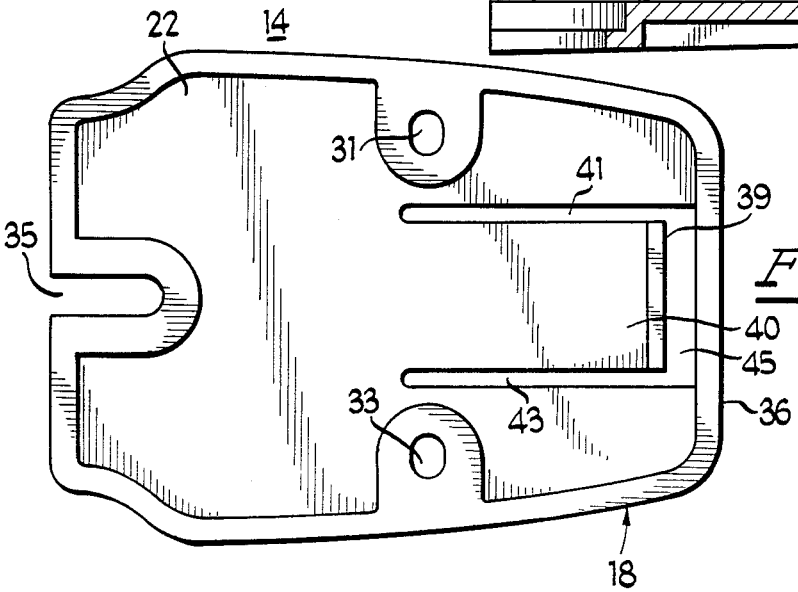
FIG. 3 is a bottom plan view of the housing in FIG. 2.
Figure 5:
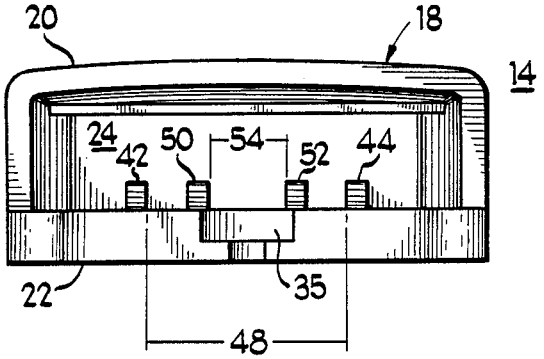
FIG. 5 is an elevational view of the housing in FIG. 2 along the line 5—5.
Figure 5:
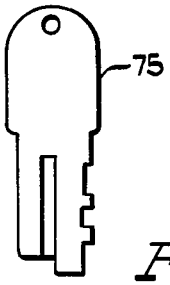

In FIGS. 2–5, shell 18 of housing 14 has an upper wall 20, a bottom wall 22 and an enclosure 24. Upper wall 20 has an outer surface 21 and an inner surface 23 with securing shoulder 30 at the perimeter of aperture 26, which is engageable by locking tongue 104 at insertion of clasp member 12 into housing 14 through opening 32 at housing open end 34. Bottom wall 22 of housing 14 in FIG. 4 is downward sloping from housing open end 34 toward closed end 36, and has a longitudinally extending ledge 38 at open end 34. An open-ended mounting slot 35 is provided in ledge 38 for adjustment and securing of housing 14 on the above-noted base or frame.

Flap 40, which is integral with and coplanar with bottom wall 22, is illustrated as a generally rectangular section bounded on two sides by slits 41 and 43, and at end 39 segment by slot 45, and is merged or extends from bottom wall 22 at its fourth side. In this configuration, flap 40 extends from the plane of bottom wall 22 and is recoverable to again be coplanar with wall 22. First ridges 42 and 44, which generally bound flap 40, are parallel and extend along bottom wall 22 from open end 34 to closed end 36 with a groove 48 therebetween. Chamfers 46 on ridges 42 and 44 at open end 34 provide a ramp-like structure to assist insertion of clasp member 12. A second pair of parallel ridges 50 and 52, which are about parallel to ridges 42, 44, are positioned on flap 40 and have a slot 54 therebetween, that is operable as a hinge or pivot slot for tumbler 16.

Figure 6:
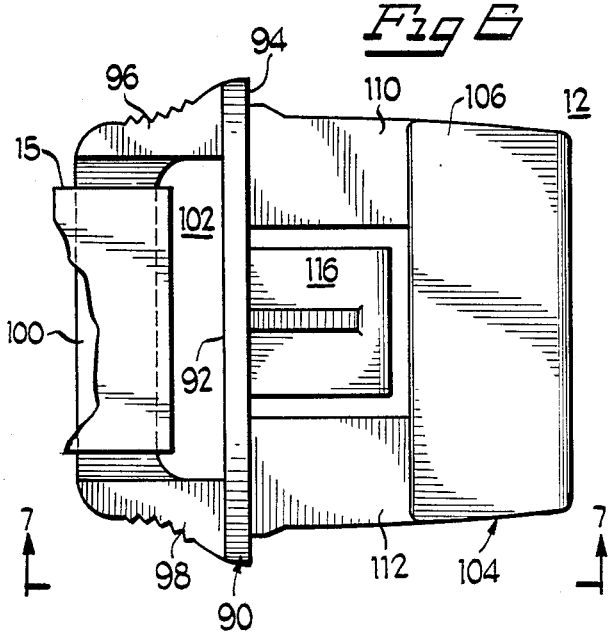
FIG. 6 is a plan view of the latch in FIG. 1.
Figure 7:
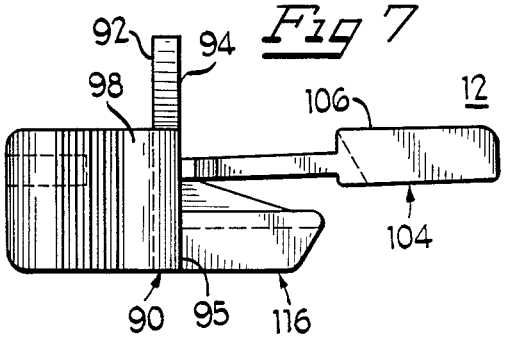
FIG. 7 is an elevational view of the latch in FIG. 6 taken along the line 7—7.

Tongue 104 and more particularly lip 106 in FIGS. 6–7, which is upwardly displaced from tongue 104, is matable with aperture 26 to secure clasp member 12 in enclosure 24, which thus secures belt 15. Tongue 104 is separated from back or inner side 94 of clasp-member body 90 by gap 102, which body 90 is illustrated with a relatively thin-walled and generally ovate shape. Flexible lever arms 110 and 112 extend normally from inner side 94 to couple tongue 104 to body 90 and also to bias tongue 104 to a reference position at the disengaged mode. Foot 116 extends normally from inner surface 94 at lower edge 95 and operates as a fulcrum and positioning means against bottom wall 22 during mating of clasp 12 and housing 14, which mating flexes and displaces tongue 104 from the reference position. Operation of clasp 12 is accommodated by gripping arms 96 and 98 extending normally from front surface 92 of latch member body 90 in an opposite longitudinal direction from lever arms 110, 112, which are coupled by bar 100 displaced from surface 92 by separating gap 102. Strap 15 is secured to bar 100 in FIG. 6 as an example of a device for securing, but it is appreciated that strap 15 could be attached to a belt or cover.

Figure 8:
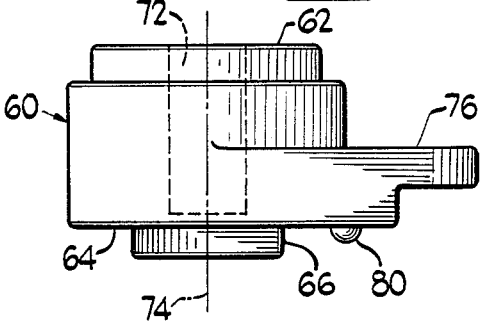
FIG. 8 an elevational view of the tumbler in FIG. 1.
Figure 9:
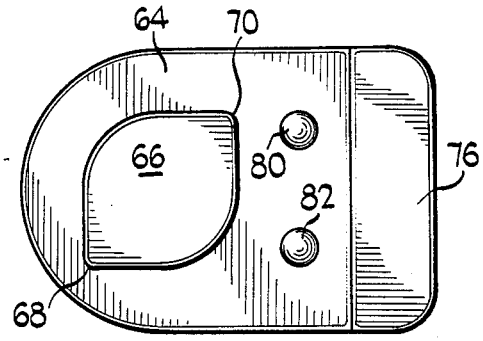
FIG. 9 is a bottom plan view of the tumbler in FIG. 8.

Tumbler 16 in FIGS. 8 and 9, the third component of three-component buckle assembly 10, is mountable in enclosure 24 with bottom surface 64 of cylinder 60 resting on second ridges 50 and 52, and pivot pad or pintle 66 positioned in slot 54. Pivot pad 66 is shown as an ovate shape with tapered and opposed ends 68 and 70 providing a positive locating means for tumbler 16. Tumbler upper surface 62 protrudes through tumbler port 28 in shell upper wall 20, and is thus rigidly supported between bottom wall 22 and upper wall 24. Insertion of tumbler 16 is accommodated by deflection of flap 40, which is angularly displaceable to nest tumbler 16 between port 28 and ridges 50 and 52. Subsequent recovery of flap 40 to its reference position, where it is coplanar with bottom wall 22, maintains tumbler 16 in port 26 until housing 14 is mounted on the base or frame to permanently secure tumbler 16 in position.

Key bore 72 extends into cylinder 60 from upper surface 62 along longitudinal axis 74 and will accept a key 75, which is exemplarily illustrated in FIG. 8, to rotate tumbler 16 and locking arm 76 between a locking and unlocking mode. Arm 76 radially projects outward from cylinder 60 and axis 74 in proximity to bottom surface 64. First and second pods 80 and 82 protrude from locking arm 76 at bottom surface 64 and are operable to locate tumbler 16 between either parallel pair of first and second ridges 42, 50 or 44, 52 at the unlocked mode.

Buckle assembly 10 is operable to secure belts, straps, covers or other apparatus and, in the exemplary illustration, clasp member 12 is connected to a belt 15 at strap 100. Housing 14 is matable with clasp 12 and may be mounted on a base or frame by securing means, such as screws or nails, inserted in bores 31 and 33 and slot 35 in bottom wall 22. Insertion of latching tongue 104 into housing clasp port 32 and enclosure 24 deflects tongue 104, while foot 116 acts as a fulcrum and guide against bottom wall 22 between first ridges 42 and 44 in groove 48 to maintain the sliding or joining position of clasp member 12 during engagement of tongue 104 in housing 14. The downward sloping bottom wall 22 provides room for locking arm 76, but also allows foot 116 to act as the fulcrum for tongue 104 without wedging the clasp 12 and housing 14 against each other to prohibit interengagement of these members. When latch-body inner face 94 contacts open end 24 of housing 14, lip 106 is aligned with and biased into aperture 26 by arms 110, 112 to secure clasp member 12 in housing 14. Although tongue 104 is displaced from its reference position during the insertion into housing 14, flexible arms 110 and 112 bias tongue 104 to the reference position and thus ensure its mating with aperture 26. Thereafter, key or driver means 75 inserted in key bore 72 can rotate tumbler 16 to move projecting arm 76 under tongue 104, which locks lip 106 into position in aperture 26 and thus locks assembly 10 and belt 15 against inadvertent or unwanted disengagement.

While only a specific embodiment of the invention has been described and shown, it is apparent that various alterations and modifications can be made therein. It is, therefore, the intention in the appended claims to cover all such modifications and alterations as may fall within the scope and spirit of the invention.

What is claimed is:

1. A lockable buckle comprising:

a housing defining an enclosure, a clasp port and a locking-tongue aperture;

a clasp member with a locking tongue, said clasp member insertable in said clasp port and enclosure to position said locking tongue in said locking-tongue aperture and to couple said clasp member and said housing in a coupled mode; and, a tumbler with a projecting arm, which tumbler is mountable and rotatable in said enclosure to move said arm to prevent displacement of said tongue and to lock said clasp member in said housing.

2. A lockable buckle as claimed in claim 1 wherein said housing has a bottom wall and a top wall;

said locking-tongue aperture is provided in said top wall, which top wall has an inner surface, an outer surface and a shoulder therebetween at said locking-tongue aperture;

said clasp member having means for biasing coupled to said locking tongue and operable to bias said locking tongue into said locking-tongue aperture to secure said clasp member and housing at said coupled mode.

3. A lockable buckle as claimed in claim 2 and further comprising a foot extending from said clasp member, said foot contacting said bottom wall in said enclosure at said coupled mode and operable as a fulcrum for said clasp member and said locking tongue.

4. A lockable buckle as claimed in claim 3 wherein said clasp member has a body with a first side, a second side and means for gripping on one of said first and second sides;

said foot, bias means and locking tongue extending from the other of said first and second sides; and, said body, gripping means, locking tongue, bias means and ramp are a single and integrally formed component.

5. A lockable buckle as claimed in claim 2 further comprising a first ridge and a second ridge on said bottom wall in said enclosure and cooperate to define a hinge slot in said enclosure;

said tumbler having a pintle insertable in said hinge slot;

said housing upper wall defining a tumbler passage generally aligned with said hinge slot, which tumbler is mounted in said passage and enclosure with said pintle nested in said hinge slot, said tumbler rotatable to move said arm between a non-locking position and a locking position at said coupled mode.

6. A lockable buckle as claimed in claim 5 wherein said housing bottom wall has a flap, which flap is integral with said bottom wall and deflectable therefrom;

said first ridge and second ridge positioned in said enclosure on said flap, which first and second ridges cooperate to provide said hinge slot and are deflectable with said flap for insertion of said tumbler.

7. A lockable buckle as claimed in claim 6 wherein said tumbler has a tumbler outer surface in proximity to said top wall in said tumbler passage and a key slot at said tumbler outer surface;

means for rotating said tumbler, said rotating means insertable in said key slot to rotate said tumbler and projecting arm between said locking and unlocking positions.

8. A lockable buckle as claimed in claim 4 wherein said gripping means further comprises a strap, which strap and clasp member body cooperate to define a gap therebetween;

a coupling member connected to said clasp member at said strap for securing to said housing at said coupled mode.

9. A lockable buckle as claimed in claim 7 wherein said bottom wall defines at least two bores;

means for securing, which securing means are insertable through said bores to anchor said housing to a mounting base to inhibit deflection of said flap and to secure said tumbler in said enclosure and passage.

10. A lockable buckle as claimed in claim 9 wherein said housing, clasp member and tumbler are plastic.

11. A lockable buckle as claimed in claim 9 wherein said bottom wall has a protruding ledge; said ledge defines a slot for a securing means and provides sliding adjustment of said housing.

* * * * *